US010350612B2

(12) United States Patent
Chang et al.

(10) Patent No.: US 10,350,612 B2
(45) Date of Patent: Jul. 16, 2019

(54) SURFACE CONDENSATION PROCESS AND DEVICE FOR EFFICIENTLY REMOVING COAL COMBUSTION FLY ASH MICROSPHERES

(71) Applicant: Shandong University, Jinan (CN)

(72) Inventors: Jingcai Chang, Jinan (CN); Chunyuan Ma, Jinan (CN); Aiping Tao, Beijing (CN); Zhen Meng, Jinan (CN); Chunyan Xu, Jinan (CN); Mingfeng Gao, Beijing (CN)

( * ) Notice: Subject to any disclaimer, the term of this patent is extended or adjusted under 35 U.S.C. 154(b) by 183 days.

(21) Appl. No.: 15/271,535

(22) Filed: Sep. 21, 2016

(65) Prior Publication Data

US 2017/0008007 A1 Jan. 12, 2017

Related U.S. Application Data

(63) Continuation of application No. PCT/CN2014/082592, filed on Jul. 21, 2014.

(30) Foreign Application Priority Data

Jun. 30, 2014 (CN) ..... 2014 1 0307428
Jun. 30, 2014 (CN) ..... 2014 2 0358329 U

(51) Int. Cl.

| | |
|---|---|
| ***B03C 3/014*** | (2006.01) |
| ***B03C 3/017*** | (2006.01) |
| ***B05B 7/00*** | (2006.01) |
| ***B05B 17/06*** | (2006.01) |

(52) U.S. Cl.

CPC ..... *B03C 3/014* (2013.01); *B03C 3/017* (2013.01); *B05B 7/0075* (2013.01); *B05B 17/0607* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,609,063 | A * | 9/1952 | Francis | F23J 11/00 95/29 |
| 3,763,634 | A * | 10/1973 | Alliger | B01D 47/06 261/118 |
| 4,169,714 | A * | 10/1979 | Calvert | B01D 51/04 209/139.1 |
| 4,378,976 | A * | 4/1983 | Rush | B01D 46/005 422/186 |
| 5,085,673 | A * | 2/1992 | Bentley | B03C 3/014 95/29 |
| 7,611,636 | B2 * | 11/2009 | Matsuura | B01D 1/16 210/198.1 |
| 8,480,787 | B2 * | 7/2013 | Gu | B03C 3/013 261/81 |
| 9,744,495 | B2 * | 8/2017 | Tu | B01D 47/066 |

(Continued)

*Primary Examiner* — Amber R Orlando
*Assistant Examiner* — Sonji Turner
(74) *Attorney, Agent, or Firm* — W&K IP (Wayne&King)

(57) ABSTRACT

A surface condensation process and device for efficiently removing coal combustion fly ash micro spheres are provided. The device is comprised of a patterned-plate type atomizer, a flow meter, an ultrasonic drive power source, an automatic temperature controller, a heat-tracing pipeline, a condensation sleeve, an electrically heated water storage tank, a water pump and an electrostatic precipitator.

1 Claim, 5 Drawing Sheets

(56) References Cited

U.S. PATENT DOCUMENTS

| | | | | |
|---|---|---|---|---|
| 2007/0131151 | A1* | 6/2007 | Chenevert | B01D 51/08<br>110/342 |
| 2012/0017759 | A1* | 1/2012 | Gu | B03C 3/013<br>95/66 |

* cited by examiner

SURFACE CONDENSATION PROCESS AND DEVICE FOR EFFICIENTLY REMOVING COAL COMBUSTION FLY ASH MICROSPHERES

CROSS-REFERENCE TO RELATED APPLICATIONS

This application is a continuation of International Patent Application No. PCT/CN2014/082592 with a filing date of Jul. 21, 2014, designating the United States, now pending, and further claims priority to Chinese Patent Application No. 201410307428.0 with a filing date of Jun. 30, 2014. The content of the aforementioned applications, including any intervening amendments thereto, are incorporated herein by reference.

FIELD OF THE INVENTION

The present application relates to the field of air pollution control, specifically to a surface condensation process and device for efficiently removing coal combustion fly ash microspheres.

BACKGROUND OF THE INVENTION

At present, most of the thermal power plants in China utilize coal-fired units. Due to the increasingly stringent requirements on air pollution control from the state, it is a trend for environmental protection to promote coal-fired emissions targets to be gradually drawn close to those of combustion engine based on ensuring low power cost and high thermal efficiency. However, in order to make the coal-fired units satisfy requirements of ultra-clean emissions targets, the main difficulty is to control the emission of fine particles in fly ash. At present, the diameter of the fine particles emitted from the outlet of electrostatic precipitator (ESP) in coal-fired power plant is ranged in 0.1-3 μm, wherein fine particles such as glass microsphere with diameter less than 2.5 μm account for more than 90% of the total escape particles. It is due to the factors of boiler type, combustion method, boiler temperature, and chemical composition of the coal. Referring to the cenosphere emitted from the coal-fired boiler electrostatic precipitator, the mass concentration of the cenosphere is ranged in 3-30 mg/m$^3$, the composition is mainly $SiO_2$ and $Al_2O_3$, and the cenosphere is characterized in fine particles, smooth and hydrophobic surface, high electrical insulation, flame retardant, temperature resistance and thermal insulation, and so on. However, due to the high specific resistance of the cenosphere (100-120° C., the specific resistance is $5\times10^{11}$-$10^{12}\Omega\cdot$cm) and its low charge performance, the efficiency of conventional electrostatic precipitation technology is limited in removal of cenosphere. In other words, for the coal-fired boiler utilizing fine ground coal powder and low nitrogen method, it is almost impossible to reach the emissions target of coal-fired ash <4.5 mg/m$^3$ by conventional ash removal technical approach only due to the contribution of microsphere itself. Therefore, deep emission control of fly ash microsphere in coal-fired power plant is the key to make the coal-fired units satisfy the emissions targets of combustion engine.

According to related researches, with surface metallization or chemical coating, the coal-fired microsphere can be used in the field of aviation, aerospace, building material, vehicle, weaponry and so on. Surface modified microsphere takes the advantages of low density, high conductivity and so on. Moreover, in some super-hydrophobic surface (such as polydimethylsiloxane (PDMS), silicon wafer, glass etc.) under the condition of condensation, the difference of uniformity that the condensate is permeated into the surface will directly affect the degree of modification on hydrophobicity and uniformity. In this sense, for the microsphere with low removal efficiency caused by low charge performance, if appropriate surface condensation process is adopted, the specific resistance of the microsphere will be decreased in the order of magnitude, which is benefit to be charged and collected under the existence of electrostatic field, and thus is significant to realize ultra-clean emission of coal-fired ash.

SUMMARY OF THE INVENTION

The present invention is based on the physicochemical properties of coal-fired ash microspheres. For the microspheres with coal-fired ash diameter less than 1 μm, its particle shape in the coal-fired ash is approximate sphere, it has fine-particle and thin-walled hollow structure, the specific surface area is high (>$10^5$ cm$^2$/g), and it is characterized by high absorbability, high adhesiveness and high surface energy and so on. In the light of the main physicochemical properties of above microspheres, the present invention provides a surface condensation process for efficiently removing coal combustion fly ash microspheres and a corresponding condensation device is designed. The present invention utilizes a special method for generating high temperature droplets, introduces the outer surface of microspheres, micro-bulges on the surface and inner surface of microspheres to occur core condensation by controlling condensation speed of atomized particles and staying time of droplets, hence decreases the specific resistance of microspheres, and then the microspheres are efficiently collected by the electrostatic precipitator.

The present invention is realized in the following manner:

1. A surface condensation process for efficiently removing coal combustion fly ash microsphere, comprising:

(1) utilizing ultrasonic waves to atomize high-temperature water into 10-20 μm monodispersing droplets of particulate matter and increasing a saturation ratio of smoke to a supersaturated state saturation ratio, wherein the saturation ratio SR>1.3;

(2) controlling temperature of the droplets to be 80-90° C., with a temperature difference of 30-40° C. between the droplets and desulfurized smoke;

(3) after the atomized droplets being accelerated by a Laval diffusion tube at a rear of an atomizer head, mixing high speed cross flow of coal-fired smoke so as to make the droplets and microspheres collide, coagulate and absorb each other, thus microsphere matter grows;

(4) in the supersaturated state, controlling temperature (20° C.) of the liquid inside a condensation sleeve and outside a smoke pipe to lower the temperature of the smoke by 1-5° C., vapor in the smoke being adsorbed on an outer surface of the microspheres due to high adsorption of the surface of the microspheres, quickly forming bead-shaped condensation with micro-bulges on the surface of the microspheres as cores, and hence decreasing a specific resistance of the microspheres by 1-2 orders of magnitude;

(5) controlling staying time of the atomized droplets in the smoke to be in the range of 300 ms-1 s before the atomized droplets entering into an electrostatic precipitator, and then the atomized droplets entering into the electrostatic precipitator with the smoke.

A surface condensation device for efficiently removing coal combustion fly ash microsphere is composed of a patterned-plate type atomizer, a flow meter, an ultrasonic drive power source, an automatic temperature controller, a heat-tracing pipeline, a condensation sleeve, an electrically heated water storage tank, a water pump and an electrostatic precipitator. Wherein the patterned-plate type atomizer comprises a heat-tracing patterned plate, a transducer, an atomizer head, a Laval tube, a main water inlet pipe and a water inlet branch pipe; 12-36 atomizer heads with a diameter of Φ 30 is welded in way of circumferential array on the patterned plate; the main water inlet pipe is welded in a center of the patterned plate, the water inlet branch pipe is welded in a circumferential direction of the patterned plate, the water inlet branch pipe is connected to the atomizer head, a ultrasonic transducer is arranged in the atomizer head, and the Laval tube is arranged at a rear of the atomizer head. The condensation sleeve is arranged in a smoke pipe between the patterned-plate type atomizer and the electrostatic precipitator, one side of the condensation sleeve is connected to a room temperature water inlet pipe, a heated water outlet pipe is arranged at the other side of the condensation sleeve and is connected to the electrically heated water storage tank. An electrical heating control apparatus is arranged respectively in the water storage tank, patterned plate and atomization pipe. A PLC automatic regulating apparatus is arranged on the condensation sleeve. The patterned plate, main water inlet pipe, branch pipe, Laval tube are all made of 316L stainless steel; and a flange of the patterned-plate type atomizer is fixed to a horizontal flange reserved in an inlet smoke pipe via bolted connection. A number of the atomizer heads welded in a circumferential direction of the patterned plate is 12-26, and a diameter of each atomizer head is 30 mm.

The specific operation process is as follows: the high-temperature water in the water storage tank with its temperature controlled by electric heater enters into an atomization system via a pump and flow meter, and is atomized in a patterned-plate type atomizer into 10-20 μm monodispersing droplets of particulate matter, and a saturation ratio of smoke is increased to a supersaturated state saturation ratio (the saturation ratio SR>1.3); the temperature of the droplets is controlled to be 80-90° C., with a temperature difference of 30-40° C. between the droplets and desulfurized smoke, to render the surface of the microspheres occur surface condensation; after the atomized droplets is accelerated by a Laval diffusion tube at a rear of an atomizer head, high speed cross flow of coal-fired smoke is mixed so as to make the droplets and microspheres collide, coagulate and absorb each other; in the supersaturated state, the temperature (20° C.) of the liquid inside a condensation sleeve and outside a smoke pipe is controlled to be decreased by 1-5° C., vapor in the smoke is adsorbed on an outer surface of the microspheres due to high adsorption of the surface of the microspheres, and quickly forms bead-shaped condensation with micro-bulges on the surface of the microspheres as cores, the droplets enter into the surface micro-recesses of the microspheres or enter into the microspheres via thin shell of the microspheres and hence decreasing a specific resistance of the microspheres by 1-2 orders of magnitude; the staying time of the atomized droplets in the smoke is controlled in the range of 300 ms-1 s, and then the atomized droplets enter into the electrostatic precipitator with the smoke; the discharge electrode of the electrostatic precipitator ionizes its surrounding gas to generate charged ions and electrons which collide with the microspheres with condensation film on its surface to charge the microspheres, the charged microsphere is absorbed on the anode plate under the electrostatic field and is irrigated into the bottom ash hopper by anode washing water, and the ash is completely cleaned and clean smoke is released into the atmosphere.

The present invention provides a surface condensation device for efficiently removing coal combustion fly ash microspheres, which utilizes a special method for generating high temperature droplets, introduces the outer surface of microspheres, micro-bulges on the surface and inner surface of microspheres to occur core condensation by controlling condensation speed of atomized particles and staying time of droplets, hence decreases the specific resistance of microspheres; combined with high-efficient collection and efficient ash clearance of the electrostatic precipitator, it can realize efficient removal of coal-fired fly ash microspheres. It can realize "near zero emission" of coal-fired smoke ash particles from coal-fired power plant, and the present invention has broad market application prospect.

Wherein, label 1 is a flow meter, 2 is a an ultrasonic drive power source, 3 is a power source display, 4 is a heat-tracing pipeline, 5 is a patterned-plate type atomizer, 6 is a condensation sleeve, 7 is an electrostatic precipitator, 8 is a high-voltage power source, 9 is an ash hopper, 10 is a room-temperature water inlet pipeline, 11 is heat exchanged water heat-tracing pipeline, 12 is an electrically heated water storage tank, 13 is a smoke inlet pipeline, 14 is an ultrasonic power regulator, 15 is a housing of the patterned-plate type atomizer, 16 is a water pump, 17 is an external heating sleeve of the water storage tank, 18 is a heating controller of the water storage tank, 19 is an ultrasonic transducer, 20 is an external heat insulation sleeve, 21 is a water inlet of a atomizer head, 22 is a main water inlet pipe, 23 is a water inlet branch pipe, 24 is a Laval outlet pipe, 25 is a patterned-plate flange, 26 is a smoke pipeline flange, 27 is the atomizer head, 28 is a patterned plate, 29 is a condensed water sleeve, and 30 is a heat exchanged water outlet pipeline.

DETAILED DESCRIPTION OF THE PREFERRED EMBODIMENT

Figure 1:
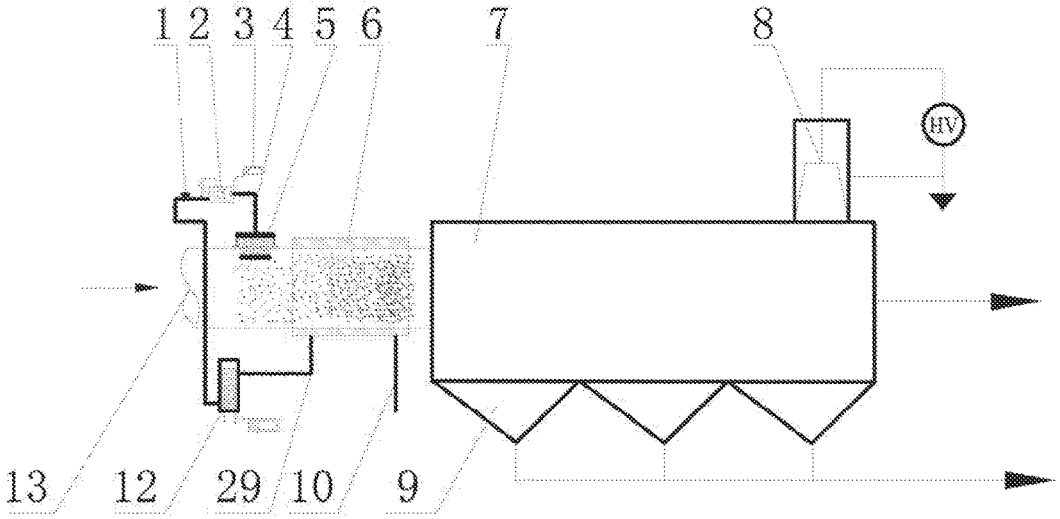
FIG. 1 is schematic view of a system for coal-fired fly ash microsphere surface condensation process.
Figure 2:
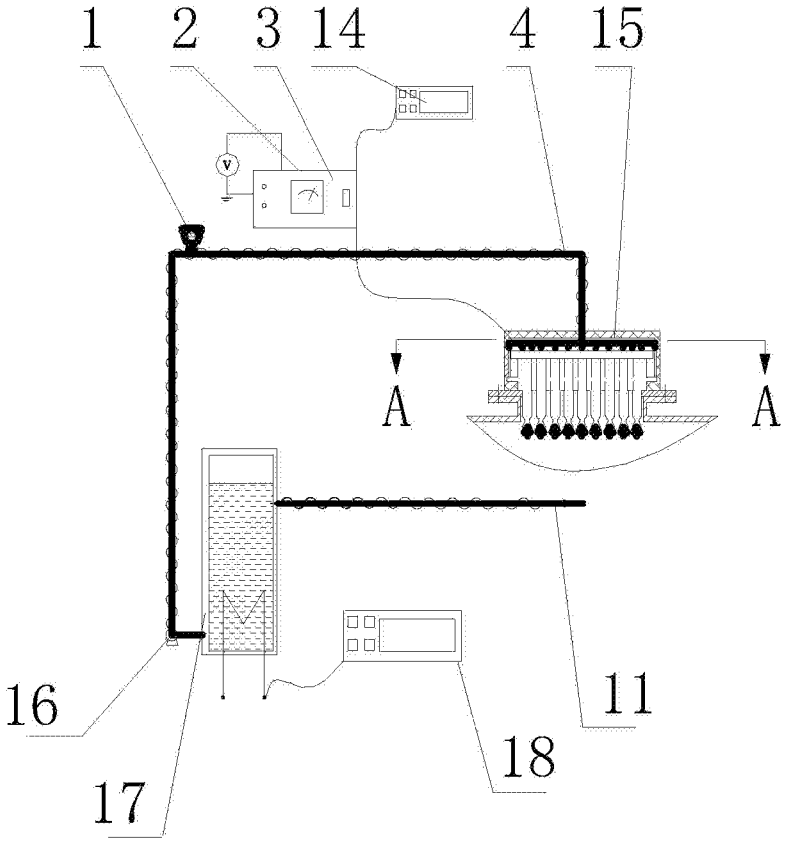
FIG. 2 is schematic view of an atomization system.
Figure 3:
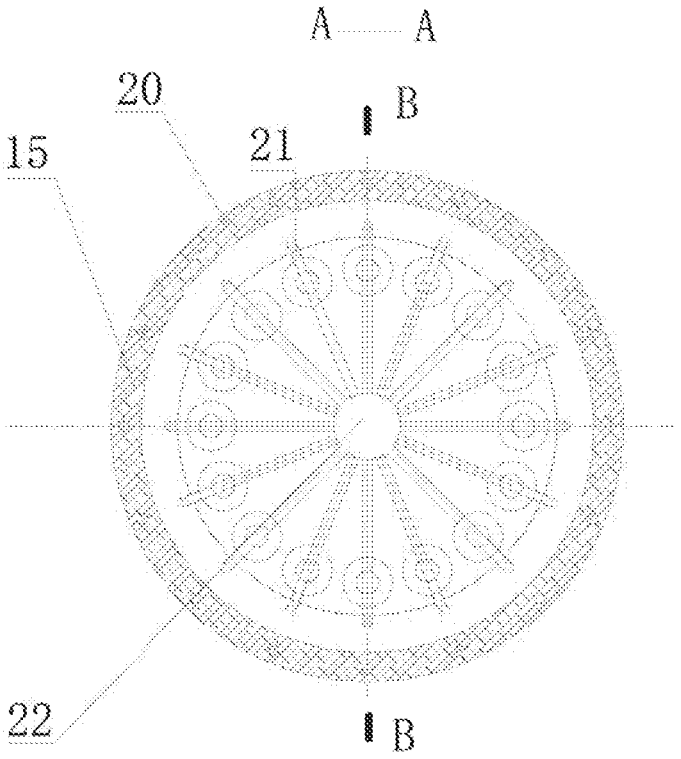
FIG. 3 is cross sectional view of a patterned-plate type atomizer along line A-A.
Figure 4:
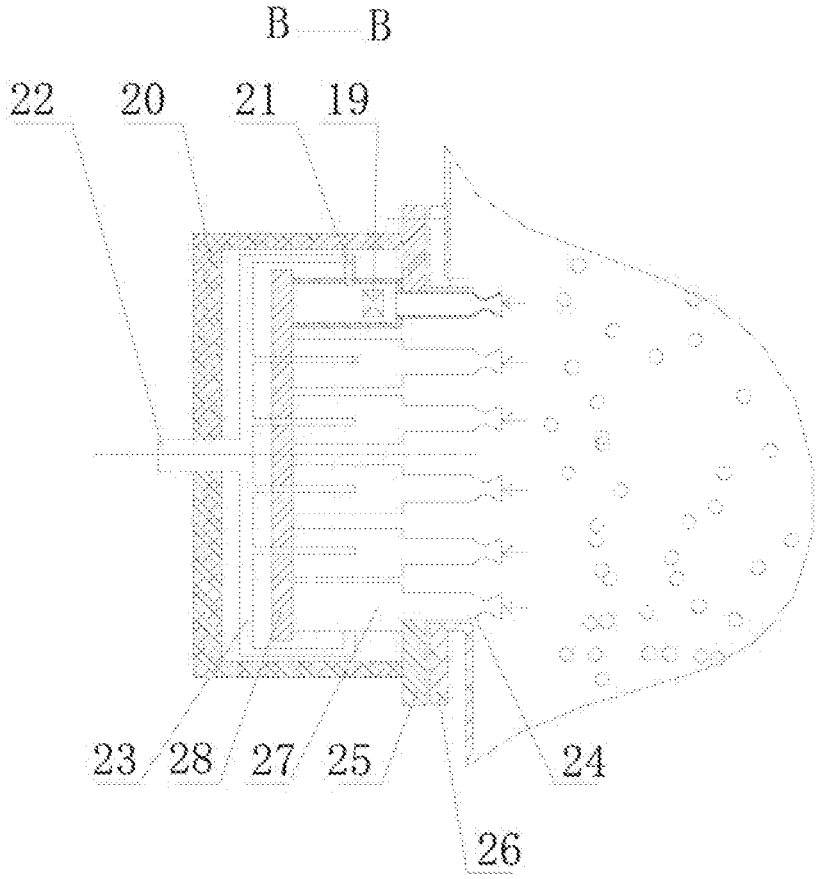
FIG. 4 is cross sectional view of the patterned-plate type atomizer along line B-B.
Figure 5:
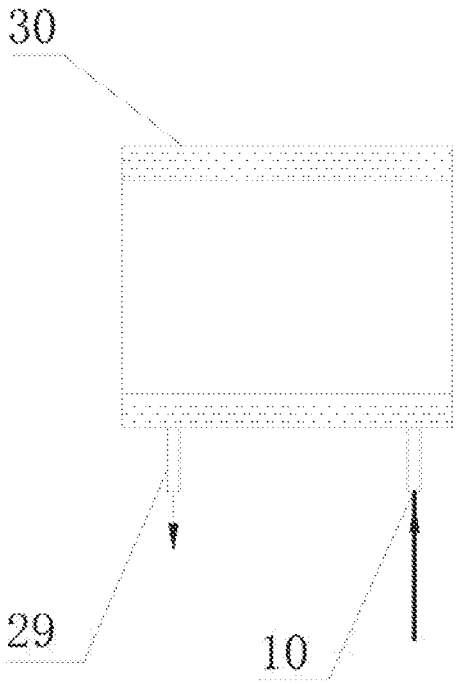
FIG. 5 is schematic view of a condensation sleeve.

The preferred embodiments of the present invention will be described in the following referring to FIGS. 1-5.

As shown in the figures, the atomization system of the present invention is composed of an electronically heated water storage tank 12, a water pump 16, a flow meter 1, an ultrasonic drive power source 2, a power source display 3, a heat-tracing pipeline 4, and a patterned-plate type atomizer 5. The patterned-plate type atomizer 5 is composed of a housing of the patterned-plate type atomizer 15, an ultrasonic power regulator 14, an external heat insulation sleeve 20, an atomizer head 27, a water inlet of an atomizer head 21, a main water inlet pipe 22, a water inlet branch pipe 23, a Laval outlet pipe 24, a patterned-plate flange 25, and a patterned plate 28, The atomizer head 27 is welded on the patterned plate 28 in way of circumferential direction, Water enters into a condensed water sleeve 30 via a room-temperature water inlet pipeline 10, exchanges heat with the smoke and then discharges from a heat exchanged water outlet pipeline 29, and the temperature of the smoke decreases 1-5° C. and the temperature of the water increases 5-10° C. The water with increased temperature automatically flows into the electrically heated water storage tank 12 under high gravity via a heat exchanged water heat-tracing pipeline 11 and is heated by a heating controller 18 of the water storage tank, and the temperature in the water storage tank is controlled by an external heating sleeve 17 of the water storage tank. The heated high-temperature water is fed into the atomization system via a water pump 16, flow meter 1 and heat-tracing pipeline 4 respectively. The ultrasonic power regulator 14 is used to regulate the parameters of the ultrasonic drive power source 2 and the power source display 3 to control atomization quantity. The high-temperature water flows into the main water inlet pipe 22 via the heat-tracing pipeline 4, and is distributed to various water inlet branch pipes 23, and then enters into the ultrasonic transducer 19 via the atomizer head 21. After high frequency vibration is applied to the water in the atomizer head 27, 10-20 μm monodispersing droplets of particulate matter are generated. The temperature of the liquid to be atomized is controlled by the external heat insulation sleeve 20 of the atomizer so as to control the temperature of the atomized droplets. After it is accelerated by the Laval outlet pipe 24 at the rear of the atomizer head, the atomized droplets enter into a smoke inlet pipeline 13. By regulating the temperature of the condensation sleeve 6 and the external heat insulation sleeve 20, the temperature of the condensation sleeve is controlled to slightly decrease (by 1-5° C.) the temperature of the smoke. Taking advantageous of the high absorbability of the surface of the microspheres, the steam in the smoke is absorbed on the surface of the microspheres or enters into the microspheres via the thin shell of the microspheres, so as to decrease the specific resistance of the microspheres by 1-2 orders of magnitude. Through the smoke inlet pipeline 13, the microspheres carried by the coal-fired smoke and the high-speed cross-flow atomized droplets thoroughly collides, aggregates and absorbs each other, the microspheres aggregate, condense and enters into the electrostatic precipitator 7 along with the smoke. A high-voltage power source 8 is used to provide high voltage for the discharge electrode of the electrostatic precipitator 7, the discharge electrode is prompted to ionize the surrounding gas to generate negative ions and electrons, and the electrons collide with the modified microspheres. The electrostatic absorption process is completed under the action of electric field. Thus, clean smoke is released into the atmosphere. The particles are irrigated into the ash hopper 9 by a water-film dust-cleaning system of the electrostatic precipitator 7, and then are discharged into ash pool.

We claim:

1. A surface condensation process for efficiently removing coal combustion fly ash microspheres, comprising:

(1) utilizing, ultrasonic waves to atomize high-temperature water into 10-20 μm monodispersing droplets of particulate matter and increasing a saturation ratio of smoke to a supersaturated state saturation ratio;

(2) controlling temperature of the droplets to be 80-90° C., with a temperature difference of 30-40° C. between the droplets and coal combustion smoke;

(3) after atomized droplets being accelerated by a Laval diffusion tube at a rear of an atomizer head, mixing high speed cross flow of coal-fired smoke to make the droplets and microspheres collide, coagulate and absorb each other to form bigger microspheres;

(4) in the supersaturated state, controlling temperature of liquid inside a condensation sleeve and outside a smoke pipe to be 20° C. to lower the temperature of the smoke by 1-5° C., vapor in the smoke adsorbed on an outer surface of the micro spheres due to high surface adsorption capability of the microspheres, quickly forming beadshaped condensation with micro-bulges on a surface of the microspheres cores, and hence decreasing a specific resistance of the microspheres by 1-2 orders of magnitude, (5) controlling the atomized droplets remaining in the smoke for 300 ms-1 s before the atomized droplets entering into an electrostatic precipitator, and then the atomized droplets enter into the electrostatic precipitator with the smoke.

* * * * *